US006564598B2

(12) United States Patent
Segawa

(10) Patent No.: US 6,564,598 B2
(45) Date of Patent: May 20, 2003

(54) DOOR LOCKING HANDLE ASSEMBLY WITH BUILT-IN COMBINATION LOCK

(75) Inventor: Shirou Segawa, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 10/150,839

(22) Filed: May 17, 2002

(65) Prior Publication Data

US 2003/0024285 A1 Feb. 6, 2003

(30) Foreign Application Priority Data

Aug. 6, 2001 (JP) ..... 2001-173589

(51) Int. Cl.[7] ..... E05B 13/10

(52) U.S. Cl. ..... 70/208; 70/210; 70/213; 70/311; 70/312; 292/336.3; 292/DIG. 31

(58) Field of Search ..... 70/208, 210, 213, 70/219, 311, 312; 292/336.3, DIG. 31

(56) References Cited

U.S. PATENT DOCUMENTS 5,467,623 A * 11/1995 Yamada et al. ..... 70/208
5,526,661 A * 6/1996 Lin ..... 70/233
6,341,512 B1 * 1/2002 Ramsauer ..... 70/208
6,363,761 B1 * 4/2002 Sauerland ..... 70/208
6,513,356 B1 * 2/2003 Yang ..... 70/213
2002/0083745 A1 * 7/2002 Hartel et al. ..... 70/208
2002/0104341 A1 * 8/2002 Hartel et al. ..... 70/208
2002/0124608 A1 * 9/2002 Segawa ..... 70/208
2002/0139155 A1 * 10/2002 Franzen ..... 70/213
2002/0189304 A1 * 12/2002 Segawa ..... 70/208

FOREIGN PATENT DOCUMENTS

GB 2037868 * 7/1980 ..... 70/213

* cited by examiner

*Primary Examiner*—Lloyd A. Gall
(74) *Attorney, Agent, or Firm*—Martin Smolowitz

(57) ABSTRACT

Although a door locking handle assembly is small as a whole in thickness in construction, it permits, through its computerized personal management system, a large number of persons or users to have easily and quickly access to their instruments contained in a box provided with the door locking handle assembly. In this assembly, a combination lock (19), which is opened by turning each of a set of its specially marked dial discs (22) a given number of times to establish a unique combination of marks of the dial discs (22), is incorporated in a door handle (13) or in a base body (1). In operation, a locking member (24) of the assembly prevents the door handle (13) from being pulled out of the base body (1), and is driven to reach its unlocked position when the combination lock (19) is opened.

7 Claims, 34 Drawing Sheets

DOOR LOCKING HANDLE ASSEMBLY WITH BUILT-IN COMBINATION LOCK

BACKGROUND OF THE INVENTION

1. Field of the Invention

The present invention relates to a door locking handle assembly with a built-in combination lock of a pull-out and side-swinging lever-action type, in which a door handle is pivoted to a base body of the assembly so as to be pulled out forward and pushed back rearward relative to the base body and turned on its pivoted end.

2. Description of the Related Art

As is well known in the art, a door locking handle assembly of a conventional type shown in U.S. Pat. No. 5,467,623, herein incorporated by reference, has a construction in which: a base body of the assembly is fixedly mounted on a door; a door handle is pivoted to the base body so as to be pulled out forward and pushed back rearward relative to the base body and further turned sideward on its pivoted end after completion of its pulling-out operation; when the door handle is pulled out of the base body to assume its pulled-up or raised inclination position relative to the base body or turned sideward after completion of its pulling-out operation, a catch plate or rack which serves as a door bolt directly or indirectly connected with the door handle is released from a receiving portion of a stationary frame element (i.e., door frame for supporting a door). In this type of conventional door locking handle assembly, a cylinder lock is incorporated in either the door handle or the base body. On the other hand, the door handle is pushed back rearward relative to the base body and held in its folded or locked position in the base body.

In the conventional door locking handle assembly, an available space for mounting the assembly is extremely limited in each of opposite sides of the door to which the assembly is fixedly mounted because the interior space of a box or container for housing various instruments therein is relatively limited due to the presence of these various instruments housed therein Due to this, it is necessary to considerably limit in height the projections of the assembly in opposite directions perpendicular to the plane of the door's surface.

In order to fulfill the above need, it is necessary to reduce in thickness the assembly as a whole by reducing in thickness the door handle and in depth the base body. However, this forces a cylinder lock of the assembly to be small in thickness.

On the other hand, in a thin-type cylinder lock, since the number of sets of disc tumblers and/or pin tumblers incorporated in the cylinder lock as components of its internal locking mechanism is small, the number of available keys of the cylinder lock is naturally limited. Due to this, in the case where there are a large number of eligible users of the instruments contained in the box provided with the door locking handle assembly which employs the cylinder lock in a condition in which these users are controlled through a computerized personal management system, it is difficult to use the conventional door locking handle assembly which employs the thin-type cylinder lock.

Although the conventional door locking handle assembly described above has been fully appreciated by users, a need exists in the art for an improved one of such door locking handle assembly, which is improved in performance.

SUMMARY OF THE INVENTION

Under such circumstances, the present invention was made. Consequently, it is an object of the present invention to provide a door locking handle assembly, which is small in thickness as a whole and capable of providing a very large number of available keys of a combination lock incorporated in the assembly, wherein a large number of eligible persons or users of various instruments contained in a box or container provided with the door locking handle assembly are precisely controlled through a computerized personal management system.

It is possible to accomplish the above object of the present invention by providing:

In a door locking handle assembly with a built-in combination lock (19), the assembly being provided with a base body (1) which is fixedly mounted on a door (2), wherein a door handle (13) is pivoted to the base body (1) so as to be capable of being pulled out forward and pushed back rearward relative to the base body (1) and also turning sideward on a locking shaft (10) after completion of its pulling-out operation, wherein a rack (12) serving as a door bolt for the door (2) is directly or indirectly connected with the door handle (13) so as to be engaged with and disengaged from a receiving portion of a stationary frame element such as a main body of a box when the door handle (13) is pulled out forward and then turned sideward on the locking shaft (10) after completion of the pulling-out operation of the door handle (13), the rack (12) being slidably supported and guided in its up and down linear motion relative to the door (2), wherein the door (2) is swingably supported by the stationary frame element, the improvement wherein:

the combination lock (19), which is provided with a plurality of marked dial discs (22), is incorporated in the door handle (13) and opened by turning each of the marked dial discs (22) a given number of times to establish a predetermined combination of marks provided in outer peripheral surfaces of the dial discs (22);

a locking member (24) for preventing the door handle (13) from being pulled out of the base body (1) is juxtaposed with an inner surface of the door handle (13) to pass through a central portion of each of the plurality of the marked dial discs (22) of the combination lock (19);

the base body (1) is provided with a projection portion (40) in an inner peripheral surface of its lower end portion, wherein the projection portion (40) is provided with a front cam slope (42) and a rear cam slope (41) to have each of the cam slopes (42, 41) be engageable with a lower-end latch member (35) which is connected with a lower end portion of the locking member (24), wherein the rear cam slope (41) of the projection portion (40) drives the lower-end latch member (35) upward against a resilient force exerted by a spring member (27) when the door handle (13) is pulled out of the base body (1) after the combination lock (19) is unlocked; and all the marked dial discs (22), the locking member (24) and the lower-end latch member (35) are resiliently urged downward under the influence of the resilient force exerted by the spring member (27), which permits the lower-end latch member (35) to be engaged with and disengaged from the projection portion (40) of the base body (1) when the combination lock (19) is locked and unlocked, respectively.

In the door locking handle assembly of the present invention having the above construction, a control operator of the instruments housed in the box allocates to each of a large number of eligible users or owners of these instruments a unique combination of marks of the marked dial discs of the combination lock for unlocking and locking the combination lock.

In opening a door of the box to use the instruments contained in the box, it is necessary for each of the eligible users to establish his or her own allocated unique combination of the marks by turning in a normal or a reverse direction each of the marked dial discs a given number of times, wherein the marks are provided in an outer peripheral surface of each of the dial discs.

When the allocated unique combination of the marks of the dial discs is established, the combination lock is unlocked to permit the locking member and the lower-end end latch member connected with the lower end portion of the locking member to move to their unlocked positions, so that the door handle is released from the base body, which permits the door handle is pulled out of the base body to assume its raised position.

When the door handle is then swung sideward in its raised position, the rack, which is slidably supported and guided in the door latch mechanism of the door, is moved up and down relative to the door latch mechanism and engaged with and disengaged from the receiving portion of the stationary frame element of the box, which permits the door of the box to be closed and opened, respectively.

BRIEF DESCRIPTION OF THE DRAWINGS

The above and other objects, advantages and features of the present invention will be more apparent from the following description taken in conjunction with the accompanying drawings in which.

Figure 1:
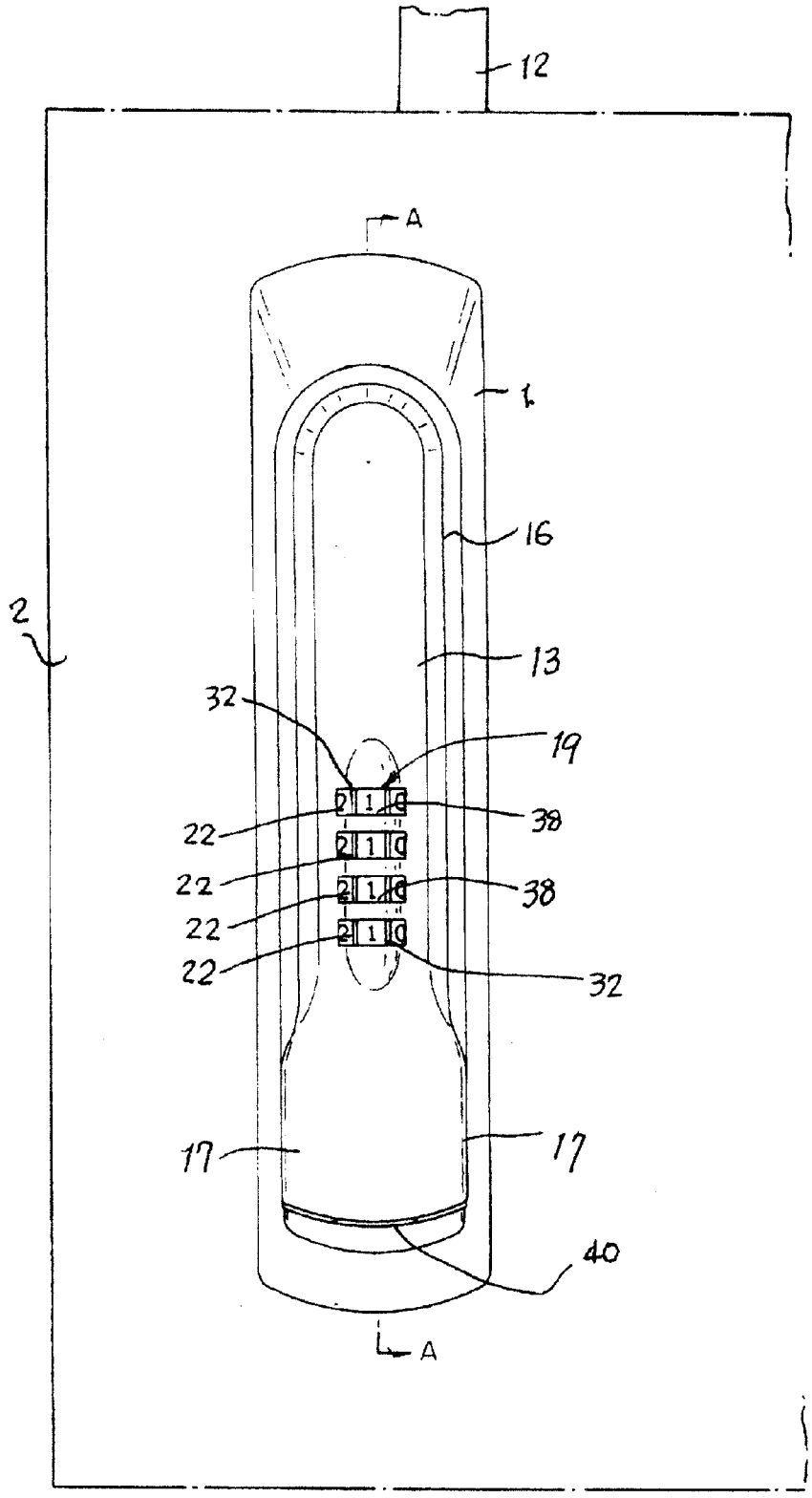
FIG. 1 is a front view of an embodiment of the door locking handle assembly of the present invention in its locked condition in which the rack is moved up as shown in phantom lines.
Figure 10:
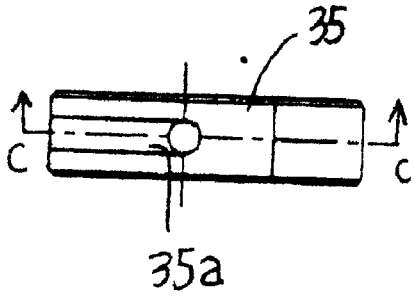
FIG. 10 is a front view of the lower-end latch member connected with the lower end portion of the locking member shown in FIG. 9.
Figure 11:
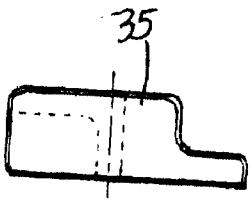
FIG. 11 is a side view of the lower-end latch member shown in FIG. 10.
Figure 12:
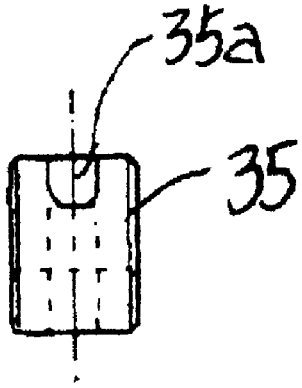
FIG. 12 is a plan view of the lower-end latch member shown in FIG. 10.
Figure 13:
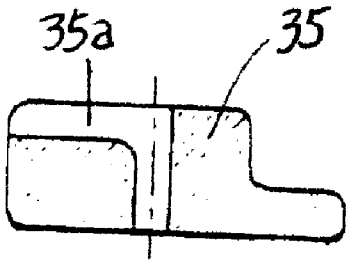
Figure 14:
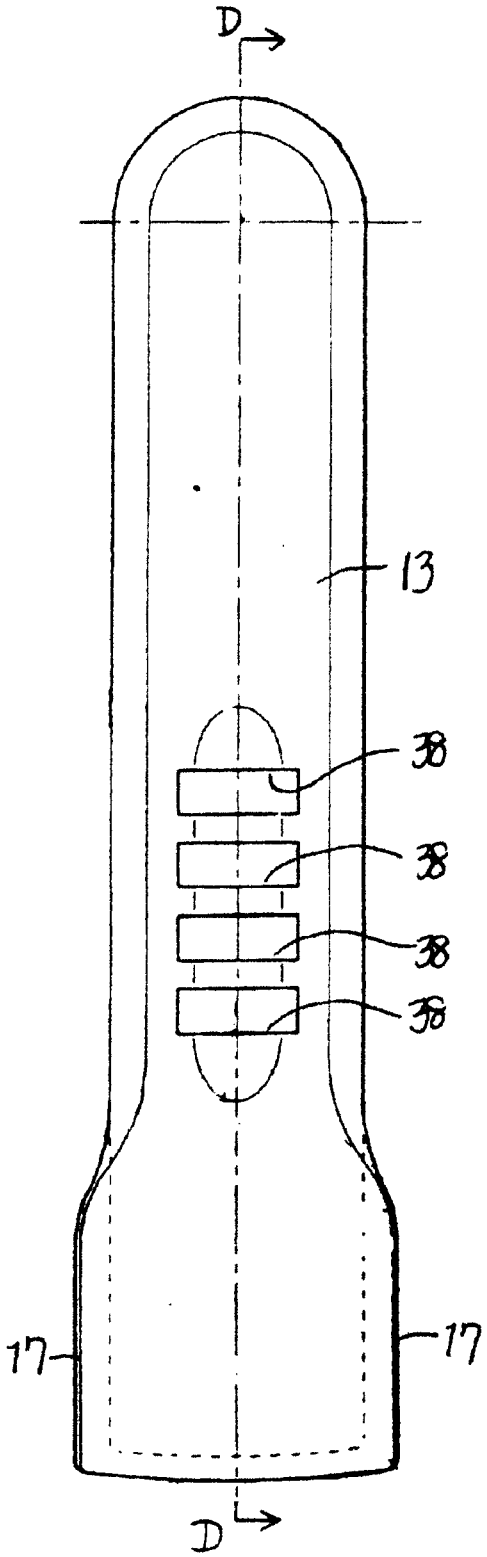
Figure 15:
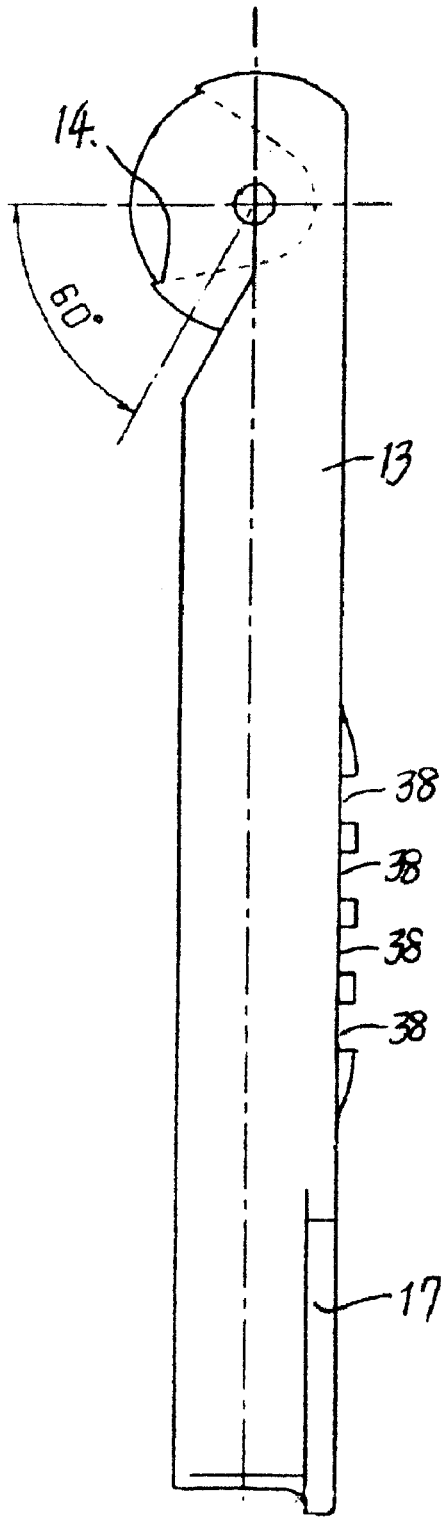
Figure 16:
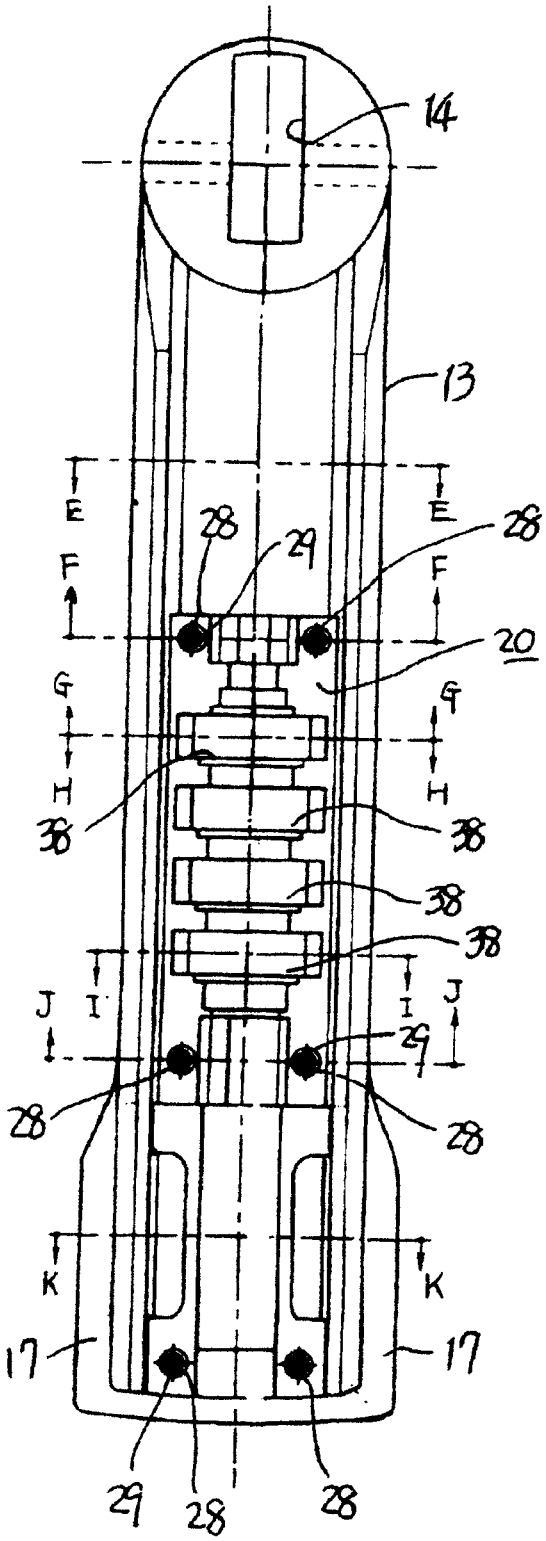
Figure 17:
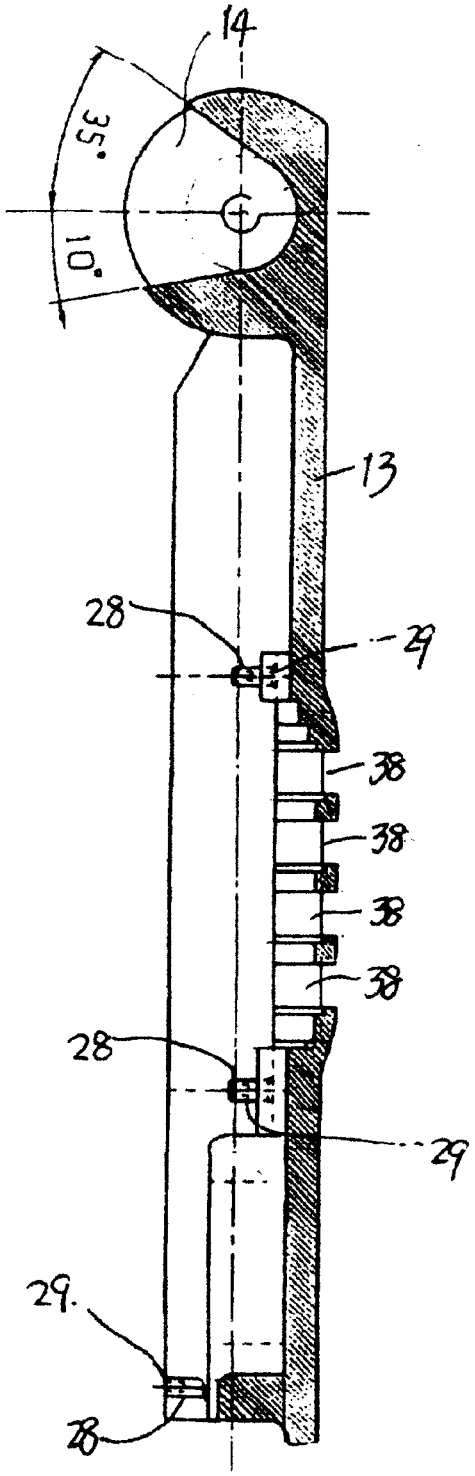
Figure 18:
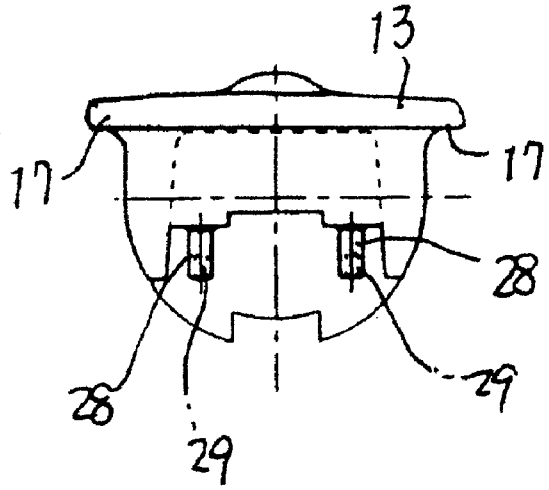
Figure 19:
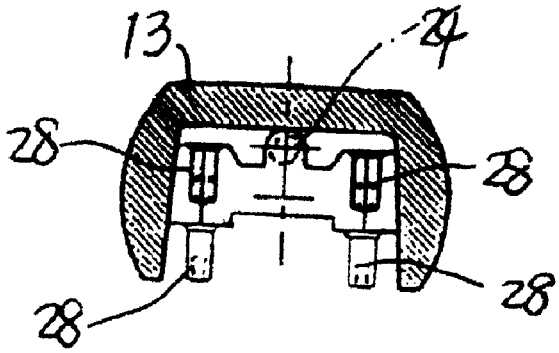
Figure 20:
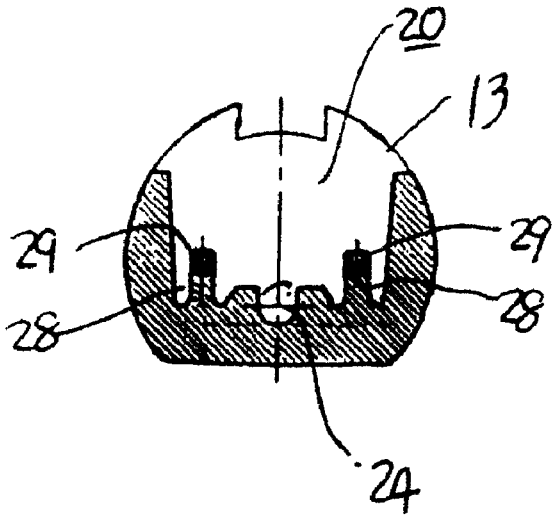
Figure 21:
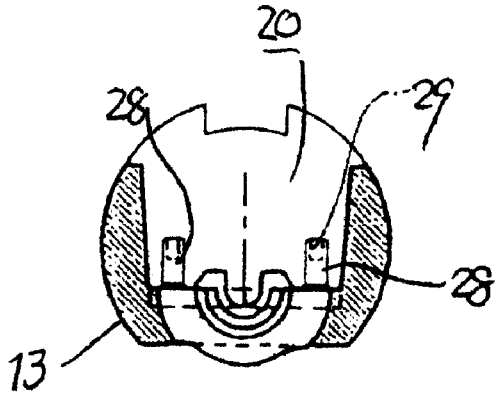
Figure 22:
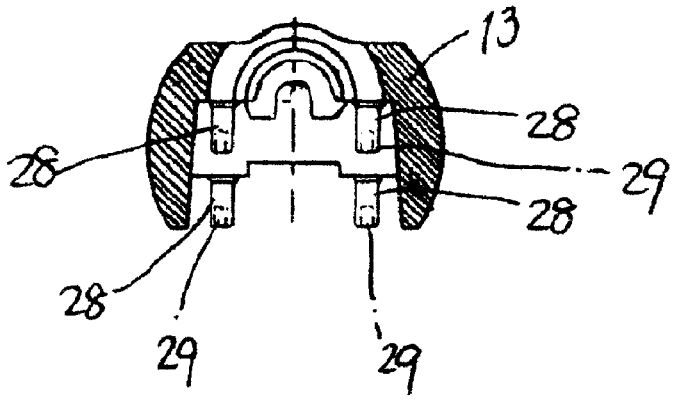
Figure 23:
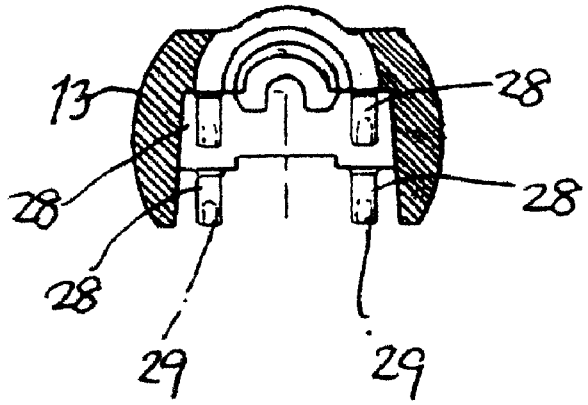
Figure 24:
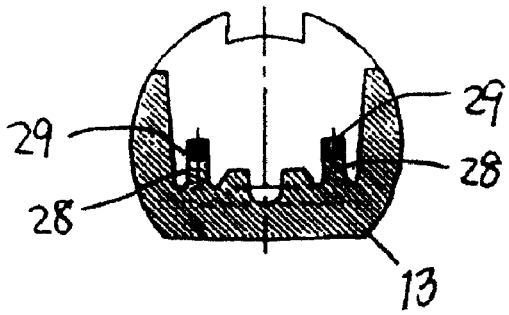
Figure 25:
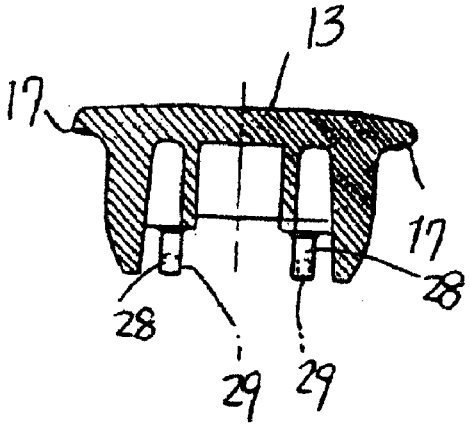
Figure 26:
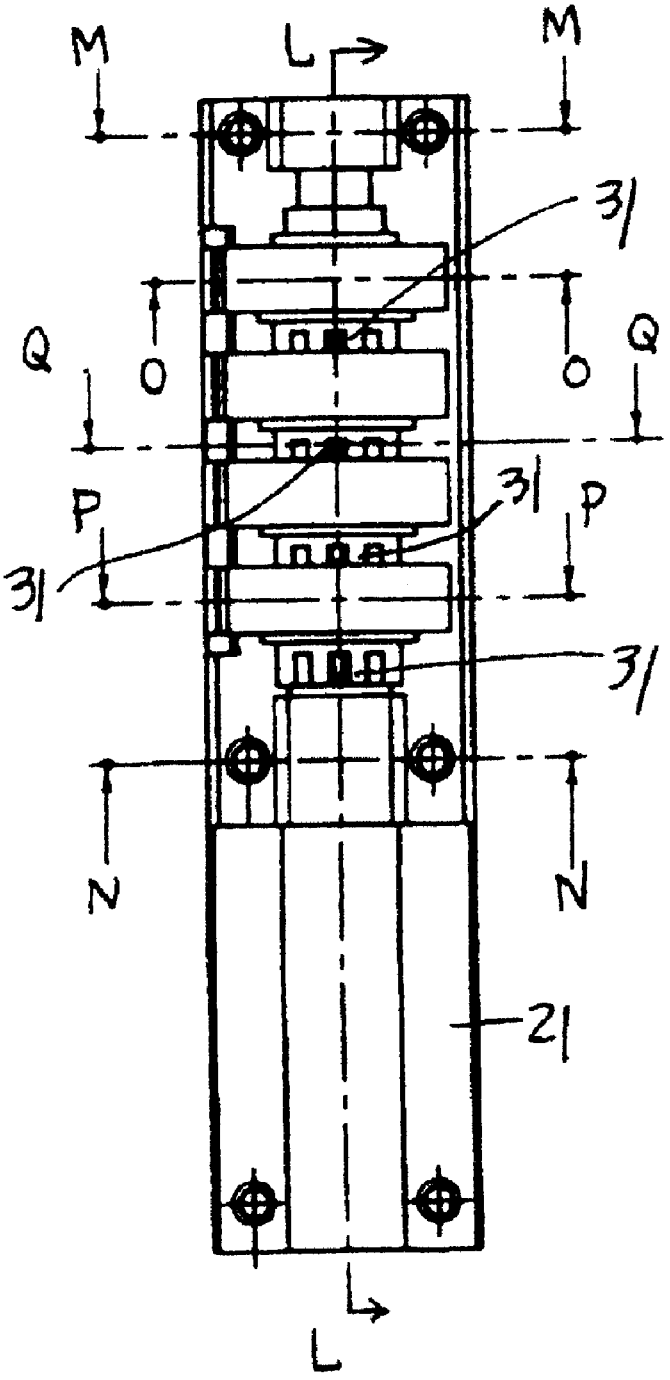
Figure 27:
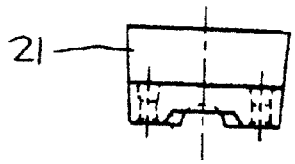
Figure 28:
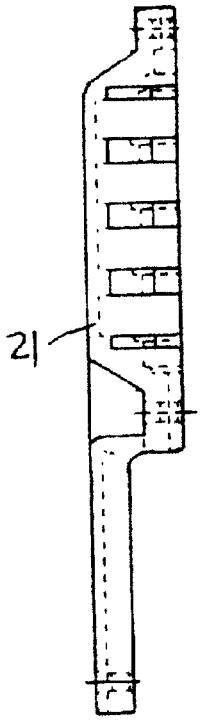
Figure 29:
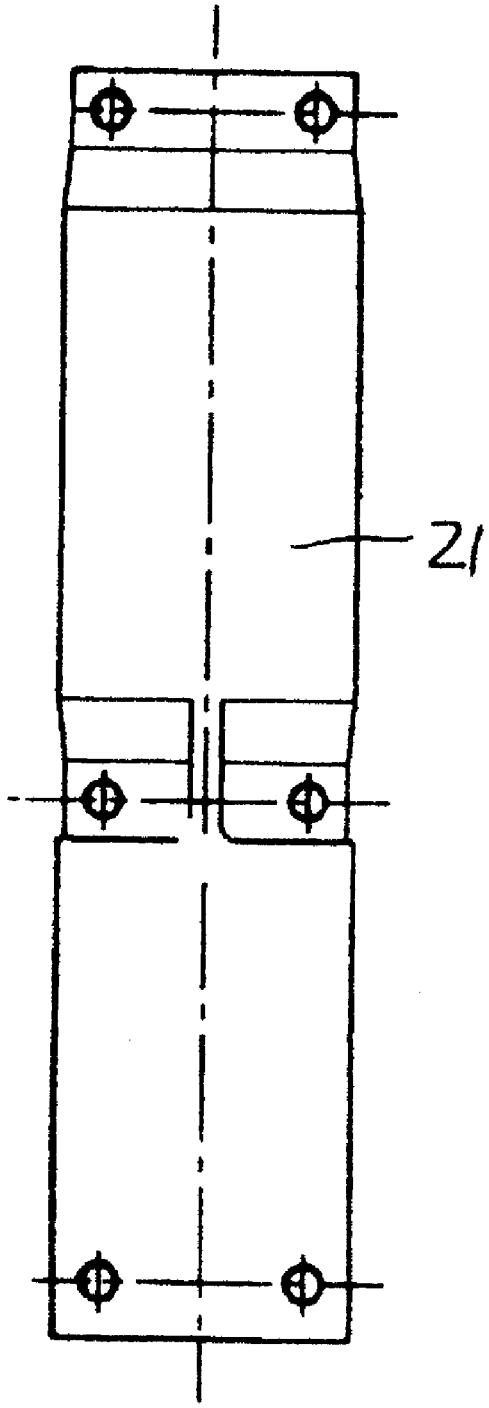
Figure 30:
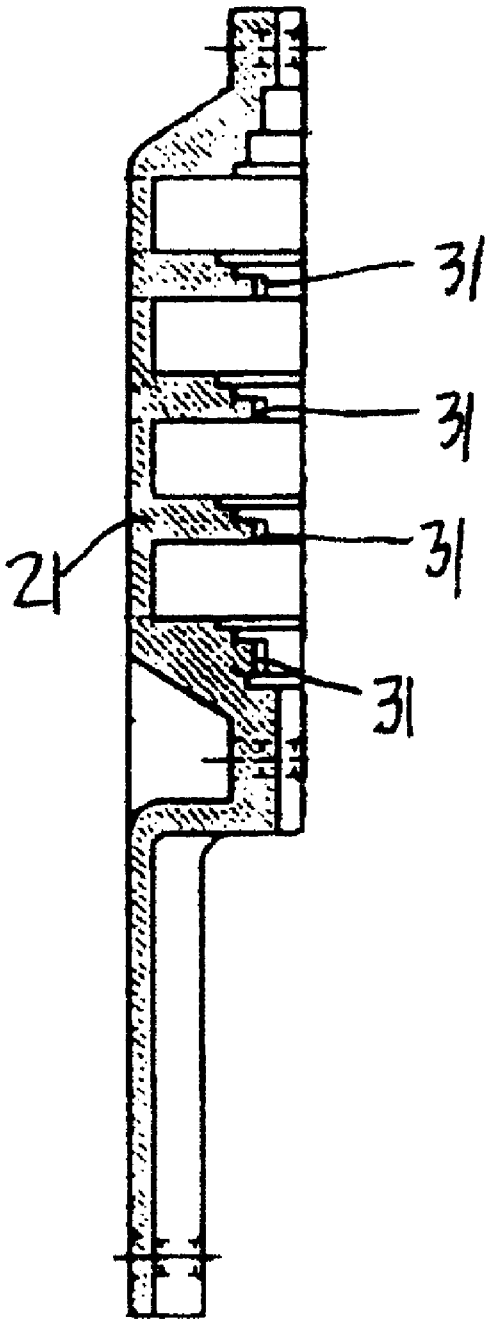
Figure 31:
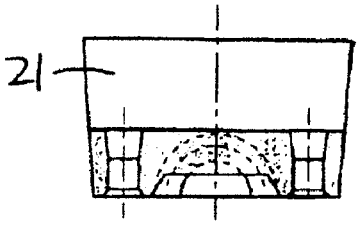
Figure 32:
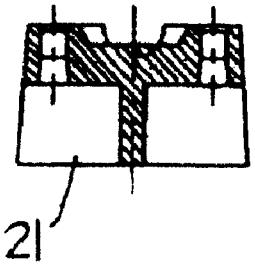
Figure 33:
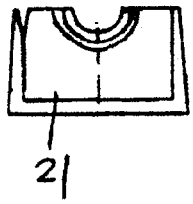
Figure 34:
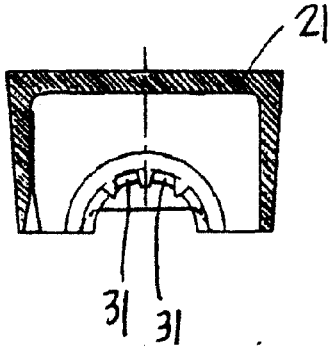
Figure 35:
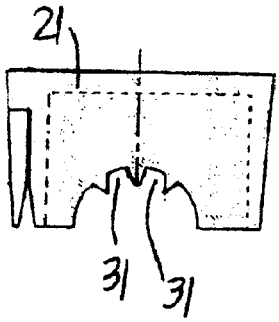
Figure 36:
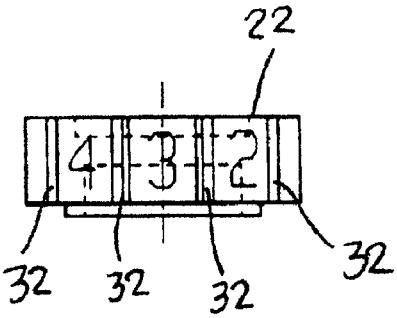
Figure 37:
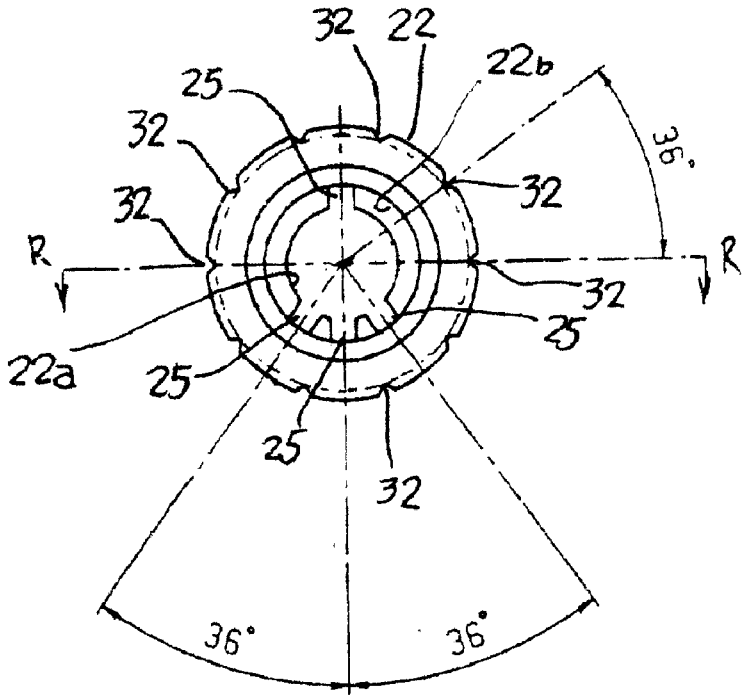
Figure 38:
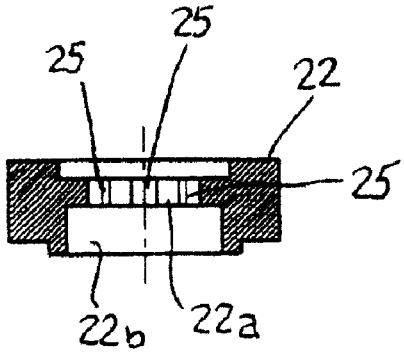
Figure 39:
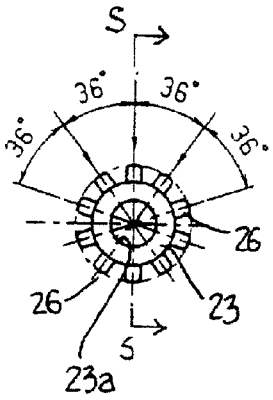
Figure 40:
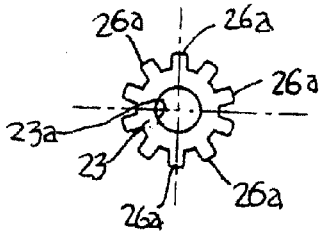
Figure 41:
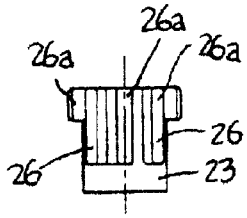
Figure 42:
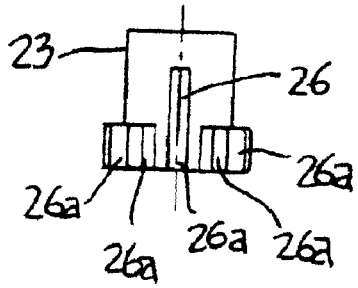
Figure 43:
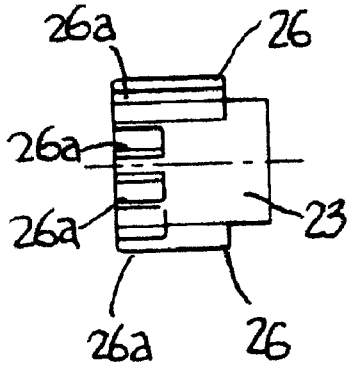
Figure 44:
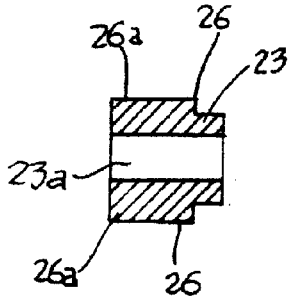
Figure 45:
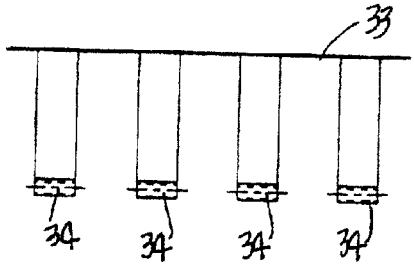
Figure 46:
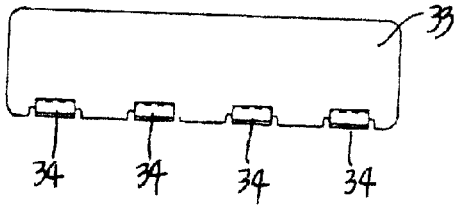
Figure 47:
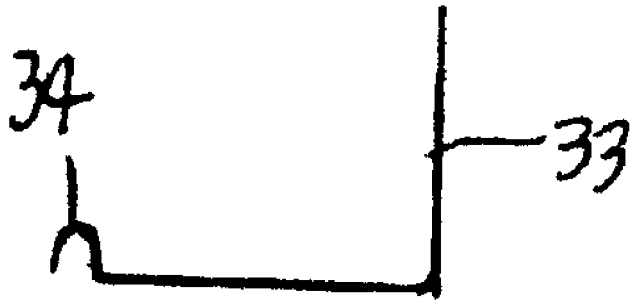
Figure 48:
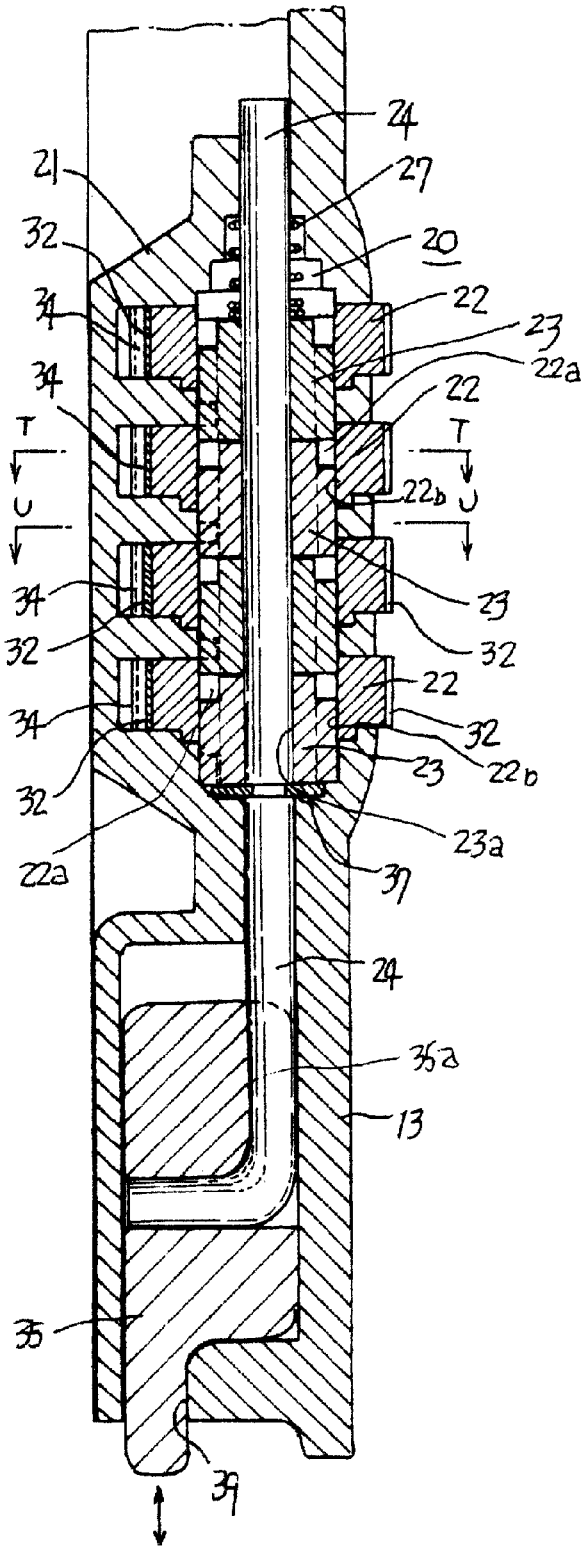
Figure 49:
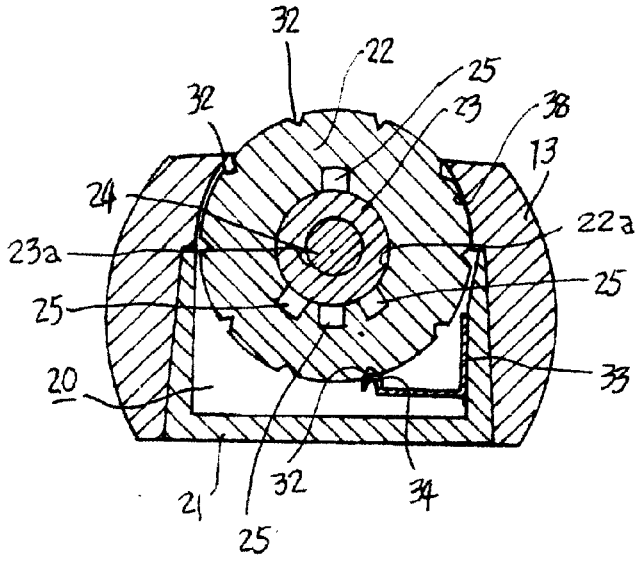
Figure 50:
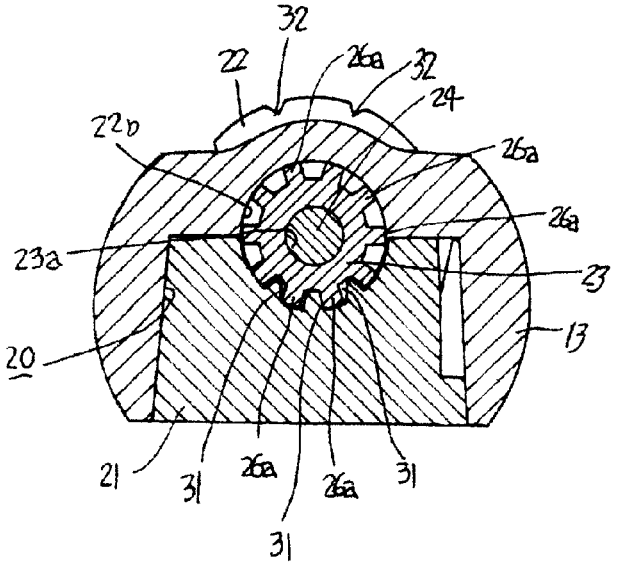
Figure 51:
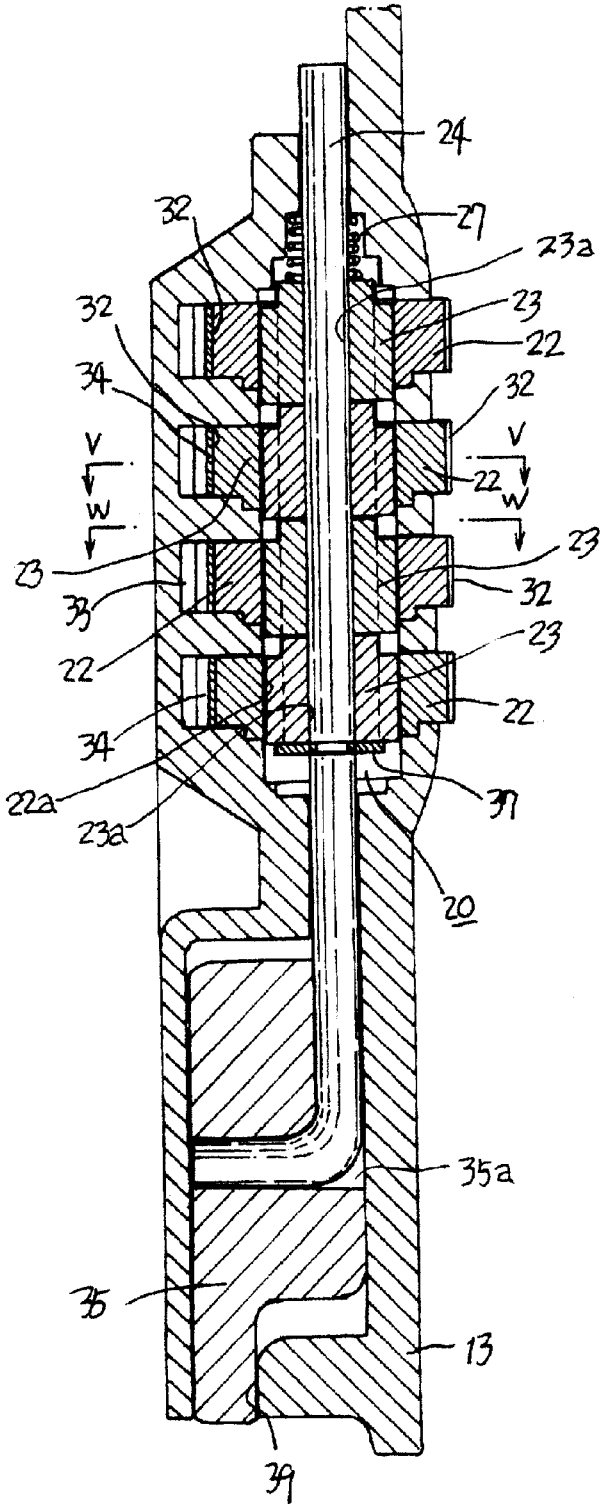
Figure 52:
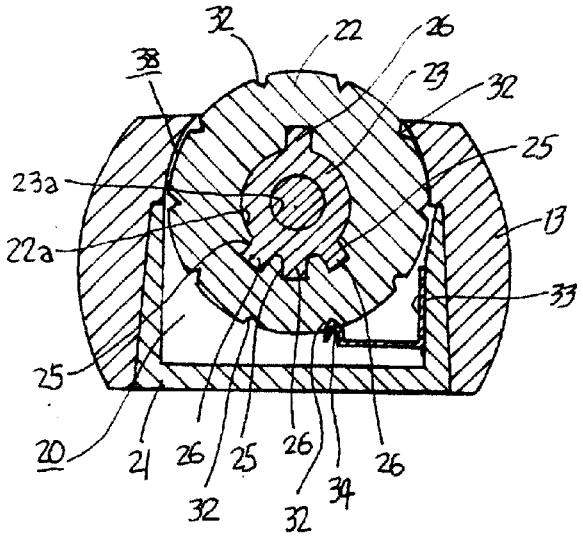
Figure 53:
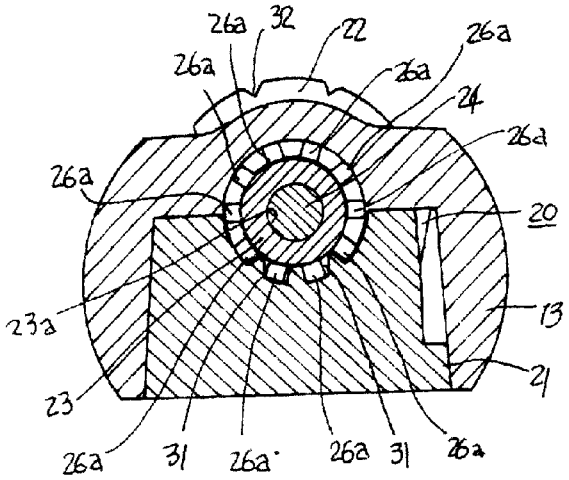

Fog. 13 is a cross-sectional view of the lower-end latch member, taken along the line C—C of FIG. 10;

FIG. 14 is a front view of the door handle employed in the door locking handle assembly shown in FIG. 1;

FIG. 15 is a left side view of the door handle shown in FIG. 14;

FIG. 16 is a rear view of the door handle shown in FIG. 14;

FIG. 17 is a longitudinal sectional view of the door handle, taken along the line D—D of FIG. 14;

FIG. 18 is a plan view of the door handle shown in FIG. 14;

FIG. 19 is a cross-sectional view of the door handle, taken along the line E—E of FIG. 16;

FIG. 20 is a cross-sectional view of the door handle, taken along the line F—F of FIG. 16;

FIG. 21 is a cross-sectional view of the door handle, taken along the line G—G of FIG. 16;

FIG. 22 is a cross-sectional view of the door handle, taken along the line H—H of FIG. 16;

FIG. 23 is a cross-sectional view of the door handle, taken along the line I—I of FIG. 16;

FIG. 24 is a cross-sectional view of the door handle, taken along the line J—J of FIG. 16;

FIG. 25 is a cross-sectional view of the door handle, taken along the line K—K of FIG. 16;

FIG. 26 is a front view of the back plate member employed in the door handle shown in FIG. 14;

FIG. 27 is a plan view of the back plate member shown in FIG. 26;

FIG. 28 is a left side view of the back plate member shown in FIG. 26;

FIG. 29 is a rear view of the back plate member shown in FIG. 26;

FIG. 30 is a longitudinal sectional view of the back plate member, taken along the line of L—L of FIG. 26;

FIG. 31 is a cross-sectional view of the back plate member, taken along the line M—M of FIG. 26;

FIG. 32 is a cross-sectional view of the back plate member, taken along the line N—N of FIG. 26;

FIG. 33 is a cross-sectional view of the back plate member, taken along the line O—O of FIG. 26;

FIG. 34 is a cross-sectional view of the back plate member, taken along the line P—P of FIG. 26;

FIG. 35 is a cross-sectional view of the back plate member, taken along the line Q—Q of FIG. 26;

FIG. 36 is a front view of the dial disc incorporated in the door locking handle assembly shown in FIG. 1;

FIG. 37 is a plan view of the dial disc shown in FIG. 36;

FIG. 38 is a longitudinal sectional view of the dial disc, taken along the line R—R of FIG. 37;

FIG. 39 is a plan view of the cam disc incorporated in the door locking handle assembly shown in FIG. 1;

FIG. 40 Is a bottom view of the cam disc shown in FIG. 39;

FIG. 41 is a front view of the cam disc shown in FIG. 39;

FIG. 42 is a rear view of the cam disc shown in FIG. 39;

FIG. 43 is a left side view of the cam disc shown in FIG. 39;

FIG. 44 is a longitudinal sectional view of the cam disc, taken along the line S—S of FIG. 39;

FIG. 45 is a front view of the resilient detent member incorporated in the door locking handle assembly shown in FIG. 1;

FIG. 46 is a left side view of the resilient detent member shown in FIG. 45;

FIG. 47 is a plan view of the resilient detent member shown in FIG. 45;

FIG. 48 is a longitudinal sectional view of the door locking handle assembly shown in FIG. 1, illustrating the components of the combination lock in its locked condition;

FIG. 49 is a cross-sectional view of the door locking handle assembly, taken along the line T—T of FIG. 48;

FIG. 50 is a cross-sectional view of the door locking handle assembly, taken along the line U—U of FIG. 48;

FIG. 51 is a longitudinal sectional view of the door locking handle assembly shown in FIG. 1, illustrating the lower-end latch member held in its retracted position;

FIG. 52 is a cross-sectional view of the door locking handle assembly, taken along the line V—V of FIG. 51; and FIG. 53 is a cross-sectional view of the door locking handle assembly, taken along the line W—W of FIG. 51.

DETAILED DESCRIPTION OF THE PREFERRED EMBODIMENTS

The best modes for carrying out the present invention will be described in detail using embodiments of the present invention with reference to the accompanying drawings.

Figure 5:
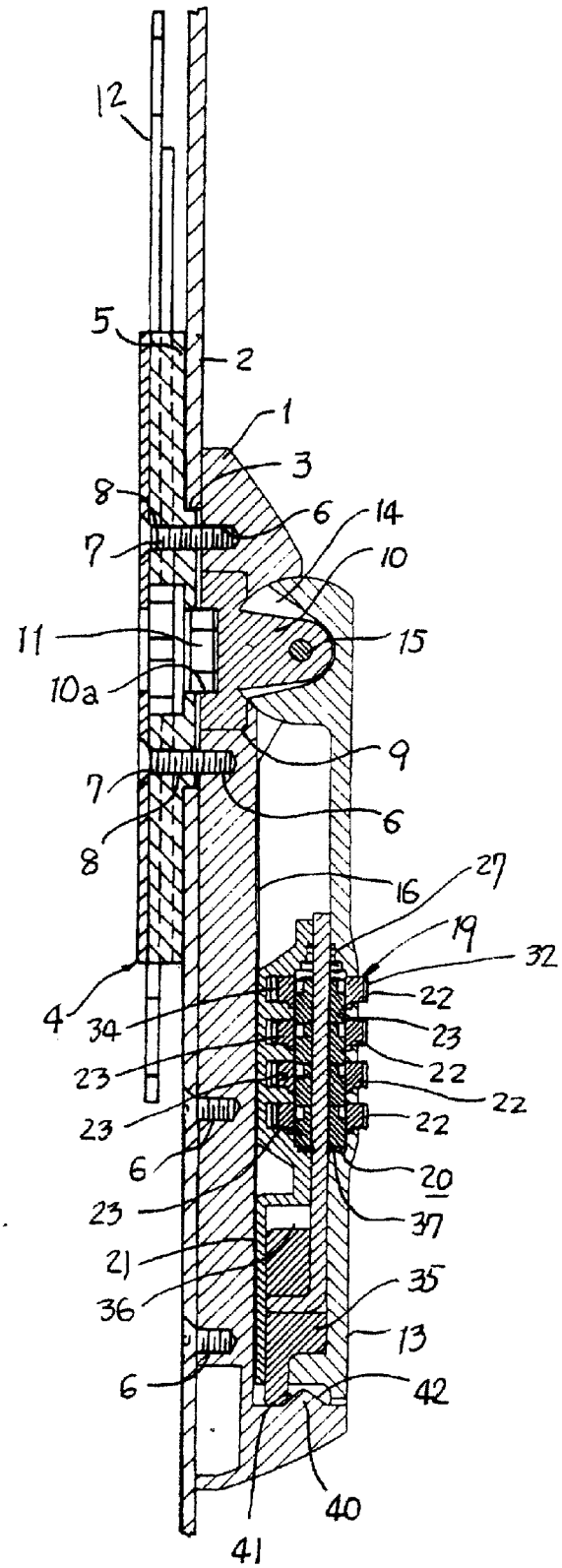
FIG. 5 is a longitudinal sectional view of the door locking handle assembly, taken along the line A—A of FIG. 1.

In an embodiment of a door locking handle assembly with a built-in combination lock according to the present invention, as shown in FIG. 5, a base body 1 of the door locking handle assembly is fixedly mounted on a front surface of a door 2, which is provided with a mounting hole 3. The door 2 is swingably supported by a stationary frame element or door frame (not shown) such as a box containing various types of instruments therein. More specifically, as shown in FIG. 5, a screw 7 is inserted into a through-hole 8 of a fastening casing 5 from its rear side, passes through this fastening casing 5 forward, and is then threadably engaged with a threaded hole 6 formed in a rear portion of the base body 1, so that a door 2 is firmly sandwiched between the base body 1 and the fastening casing 5. Incidentally, the fastening casing 5 is combined with a rack 12 to form a door latch mechanism 4, wherein the rack 12 is slidably supported and guided to serve as a door bolt for the door 2.

On the other hand, a bearing hole 9 is formed in an upper portion of the base body 1 to extend in a direction perpendicular to a front surface of the door 2. Rotatably received in such a bearing hole 9 of the base body 1 in an insertion manner is a locking shaft 10. As is clear from FIG. 5, the locking shaft 10 is provided with a shoulder portion in its substantially intermediate portion. This intermediate shoulder portion of the locking shaft 10 prevents the locking shaft 10 from axially sliding relative to the base body 1. The locking shaft 10 is provided with a square hole 10*a* in its rear portion. Fixedly received in such a square hole 10*a* of the locking shaft 10 in an insertion manner is a corresponding square column portion formed in a front end portion of a pinion shaft 11. As is clear from FIG. 6, the pinion shaft 11 is provided with a pinion gear formed in an outer peripheral surface of its rear end portion. Such a pinion gear of the pinion shaft 11 meshes with a rack 12. The rack 12 serves as a door bolt for the door 2. The rack 12 is slidably supported and guided in the door latch mechanism 4 of the door 2, and capable of moving up and down relative to the door latch mechanism 4 so as to be engaged with and disengaged from a receiving portion "3" of a stationary frame element "2" of a box containing the various types of instruments therein, which permits the door "1" of the box to be opened, wherein: the reference numerals "3", "2" and "1" enclosed in double quotation marks are used in the prior art: U.S. Pat. No. 5,467,623, herein incorporated by reference.

Figure 2:
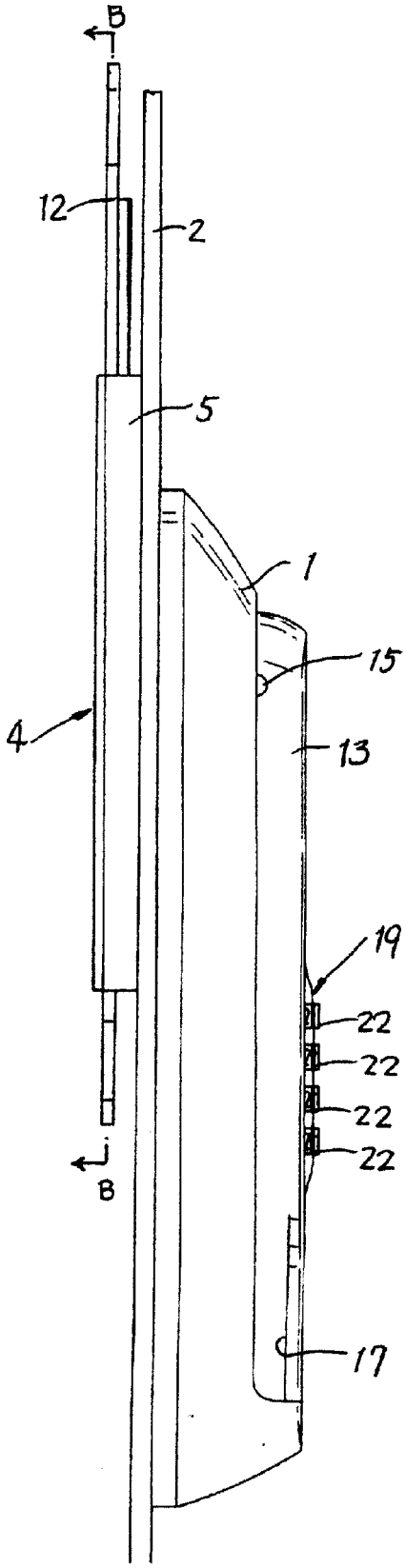
FIG. 2 is a left side view of the door locking handle assembly shown in FIG. 1.
Figure 3:
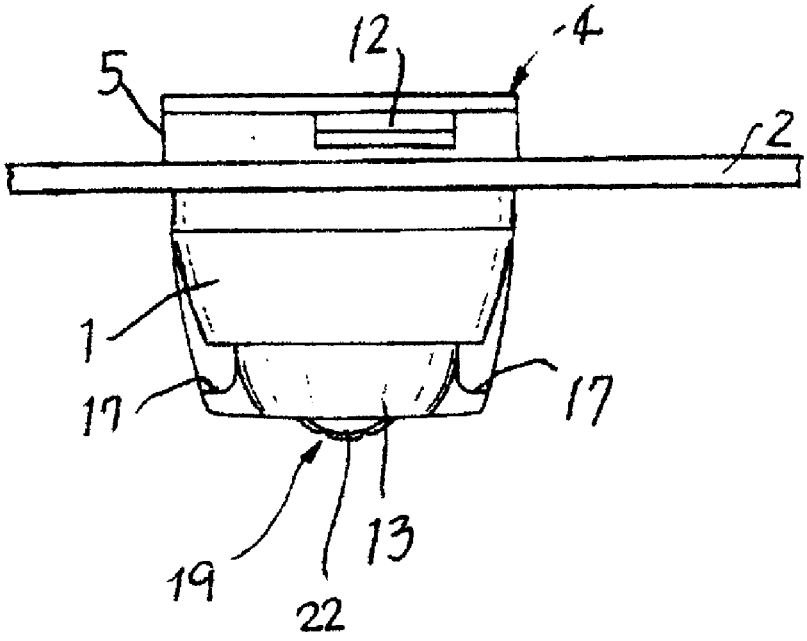
FIG. 3 is a plan view of the door locking handle assembly shown in FIG. 1.
Figure 4:
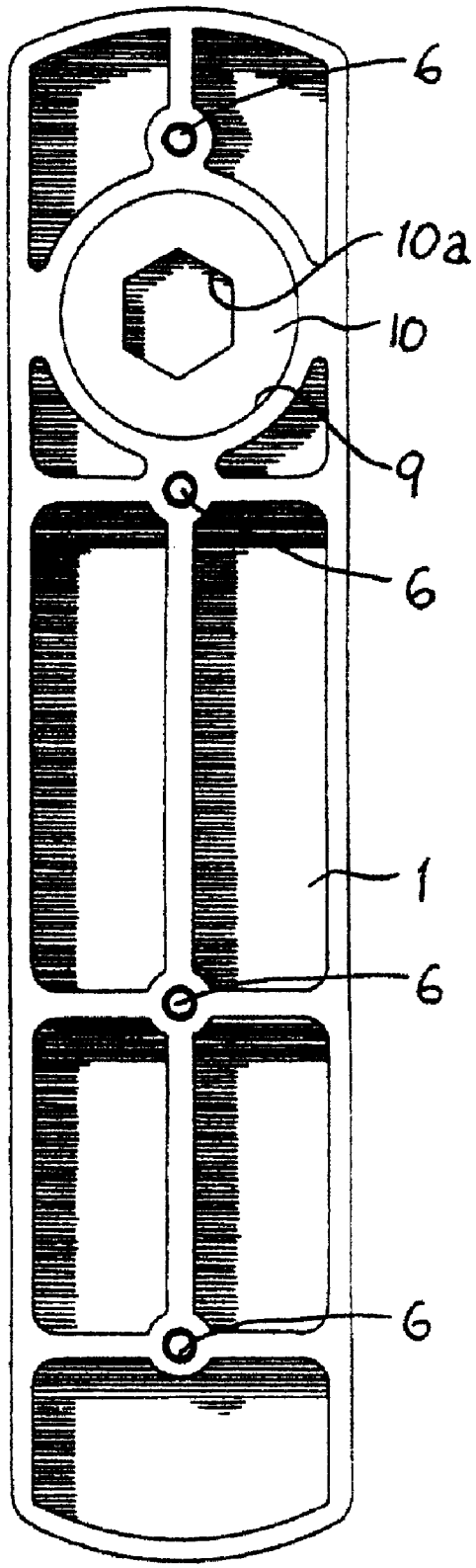
FIG. 4 is a rear view of the door locking handle assembly shown in FIG. 1 in a condition in which a door latch mechanism including the rack is removed.

As is clear from FIG. 5, formed in an upper rear portion of the door handle 13 is a concave portion 14. The concave portion 14 assumes a substantially fan-like shape in longitudinal section to swingably receive therein a front end portion of the locking shaft 10. More specifically, the door handle 13 had its upper end portion corresponding to its concave portion 14 pivoted to the front end portion of the locking shaft 10 through a cross pivot 15. The cross pivot 15 extends in parallel with a front surface of the door 2 in a direction perpendicular to the longitudinal axis of the door handle 13. In operation, when the door handle 13 is folded down so as to be embedded in the base body 1, it is possible for a front concave portion 16 of the base body 1 to receive therein a rear portion of an essential part of the door handle 13. As shown in FIGS. 1 and 2, formed in each of opposite sides of a lower end portion of the door handle 2 is a flange serving as a fingertip engaging edge portion 17, which bulges out sideward in a direction perpendicular to the longitudinal axis of the door handle 13. As is clear from FIG. 2, even when the door handle 13 is in its folded position, both the fingertip engaging edge portions 17 of the door handle 13 are still spaced apart forward from a front surface of the corresponding lower portion of the base body 1, which enables the user to pick up the lower free end portion of the door handle 13 in an easy manner.

Figure 6:
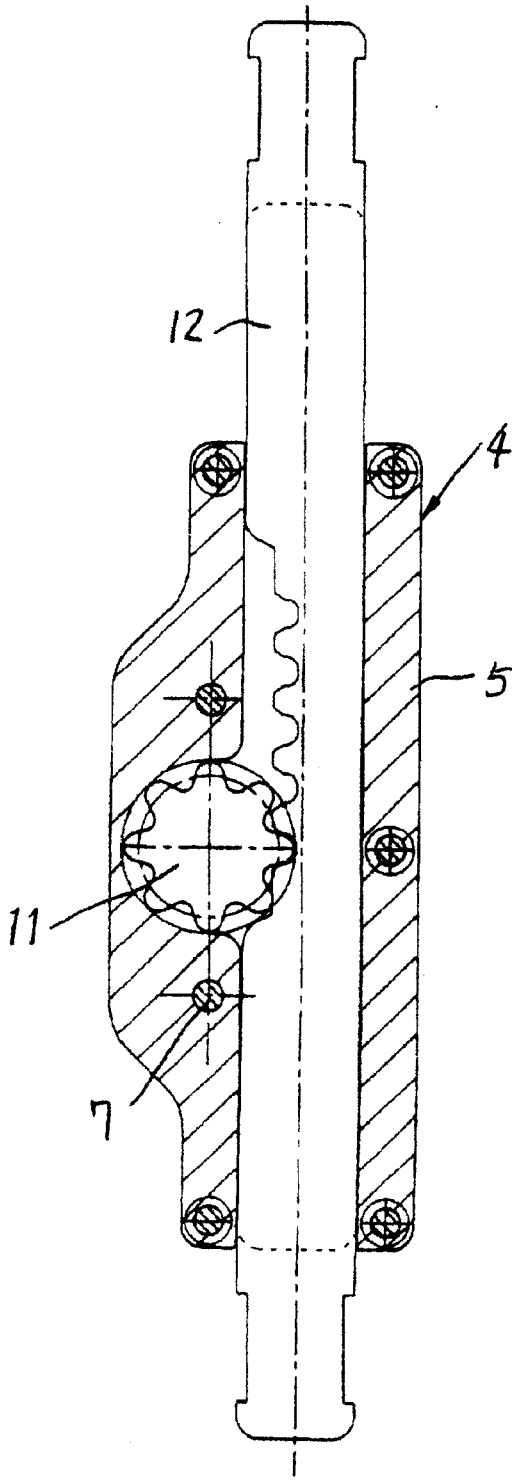
FIG. 6 is a longitudinal sectional view of the door locking handle assembly, taken along the line B—B of FIG. 2.
Figure 8:
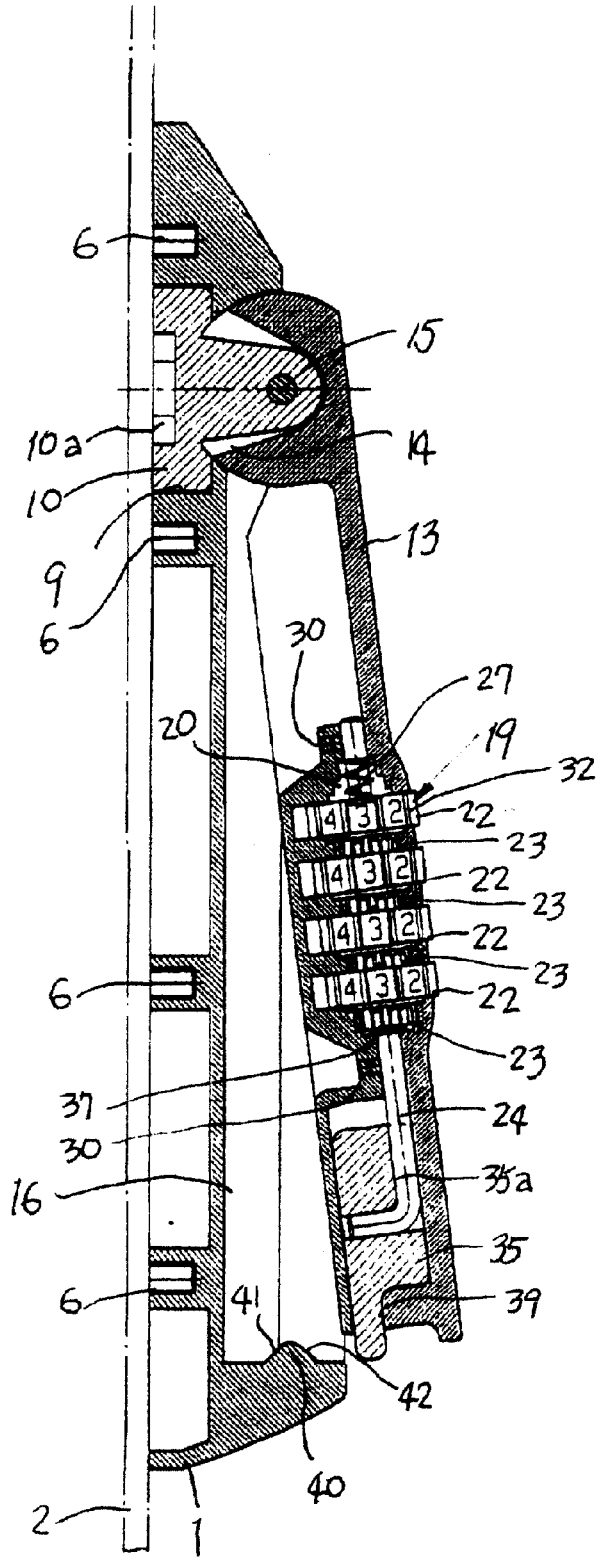
FIG. 8 is a longitudinal sectional view of the door locking handle assembly, taken along the line A—A of FIG. 1, which illustrates the door handle after completion of its unlocking process.
Figure 9:
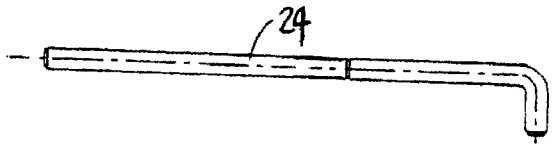
FIG. 9 is a side view of the locking member incorporated in the door locking handle assembly shown in FIG. 1.

On the other hand, when the door handle 13 is in its raised position in which the door handle 13 is inclined forward as viewed in FIG. 8, it is possible for the user to swing sideward or rotate the door handle 13 on the locking shaft 10 relative to the base body 1. In construction, as shown in FIG. 5, the locking shaft 10 has its rear end portion coaxially fixed to a pinion shaft 11. As shown in FIG. 6, the pinion shaft 11 is provided with a pinion gear in an outer peripheral surface of its rear end portion. Due to the above construction, the locking shaft 10 thus rotated together with the door handle 13 rotatably drives the pinion shaft 11 so as to rotate the pinion gear of the pinion shaft 11. As shown in FIG. 6, since the pinion gear of the pinion shaft 11 meshes with the rack 12 serving as the door bolt of the door 2, the rack 12 is slidably moved up and down relative to the door 2 when the door handle 13 is turned on the locking shaft 10. As a result, the door 2 is unlocked or released from the stationary frame element which is denoted by the reference numeral "2" in the prior art: U.S. Pat. No. 5,467,623, herein incorporated by reference. This makes it possible for the user to open the door 2 by simply pulling the door handle 13 forward. Consequently, it is possible for the user to inspect and maintain his or her own instruments contained in the main body of the box.

Formed in an intermediate portion of the door handle 13 to extend in the longitudinal direction of the door handle 13 is an elongated hollow portion 20 (shown in FIG. 5) for receiving therein a combination lock 19. The hollow portion 20 of the door handle 13 is open at the rear side of the door handle 13 to form an opening which is covered by a back plate member 21.

The combination lock 19 is constructed of a plurality of its components. Essential ones of these components of the combination lock 19 are: a plurality of marked dial discs 22; a plurality of cam discs 23 combined with the dial discs 22; a rod-shaped locking member 24; and, a lower-end latch member 35 connected with a lower end portion of the locking member 24 for preventing the door handle 13 from being pulled out of the base body 1 As is clear from FIG. 5, a lower end portion of the locking member 24 is bent to form a lower-end bent portion which is inserted in a bent recess 35*a* (shown in FIG. 7) of the lower-end latch member 35, so that the locking member 24 is connected with the lower-end latch member 35.

As is clear from Fig. FIG. 50, each of the cam discs 23 assumes a short cylindrical shape, and is provided with a through-hole 23*a* which extends in a direction perpendicular to the paper of FIG. 50 to axially pass through a center of the cam disc 23. The looking member 24 passes through the through-hole 23*a* of the cam disc 23. On the other hand, as shown in FIG. 38, each of the marked dial discs 22 is provided with a small-diameter bore portion 22*a* and a large-diameter bore portion 22*b*. These bore portions 22*a*, 22*b* are combined with each other to form a through-hole, which axially passes through a center of each of the dial discs 22. As is clear from FIG. 51, a spring member 27 is constructed of a compression coil spring to exert its resilient force on the uppermost one of the cam discs 23. In operation, when the lowermost one of the cam discs 23 is axially moved upward against a resilient force exerted by the coil spring member 27 relative to the corresponding dial disc 22 to have its upper end portion enter the small-diameter bore portion 22*a* of the corresponding dial disc 22, this cam disc 23 has an interlocking projection 26 of its outer peripheral surface engaged with an interlocking groove 25 of an inner peripheral surface of the small-diameter bore portion 22*a* of the corresponding dial disc 22. In contrast with this, in locked condition of operation shown in FIG. 48, the cam disc 23 has its lower portion extend downward from the small-diameter bore portion 22*a* of the corresponding dial disc 22 under the effect of the resilient force exerted by the spring member 27. Consequently, as is clear from FIG. 48, in this locked condition of operation, the interlocking projection 26 (shown in FIG. 44) of the cam disc 23 is disengaged from the interlocking groove 25 (shown in FIG. 38) of the corresponding dial disc 22.

As shown in FIG. 40, the cam disc 23 is provided with a plurality of positioning projections 26*a* in its outer peripheral surface. The number of these positioning projections 26*a* is equal to the number of a plurality of marks having been applied to an outer peripheral surface of the dial disc 22. These marks are denoted by the Roman numerals, for example such as "4", "3", "2", as shown in FIG. 36, and spaced apart from each other at predetermined equal angular intervals. As shown in FIG. 44, the positioning projection 26*a* of the cam disc 23 is formed in a proximal end portion of the interlocking projection 26. On the other hand, the back plate member 21 is fixedly mounded on the inner surface of the door handle 13 by means of a plurality of screws 30 (shown in FIG. 7), each of which screws 30 is threadably engaged with a threaded hole 29 (shown in FIG. 23) of each of a plurality of guide projections 28. As shown in FIG. 26, the back plate member 21 is provided with at least one positioning groove 31, which is engaged with at least one of the positioning projections 26*a* of the cam disc 23 (shown in FIG. 41).

As shown in FIG. 37, a plurality of detent grooves 32 are formed in an outer peripheral surface of the dial disc 22 at predetermined equal angular intervals in a manner such that each of the detent grooves 32 is sandwiched between adjacent ones of the numeral marks having been applied to the outer peripheral surface of the dial disc 22. Consequently, the number of the detent grooves 32 is equal to that of the marks applied to the outer peripheral surface of the dial disc 22. As shown in FIG. 49, a detent leaf spring 33 is fixedly mounted in the elongated hollow portion 20 of the door handle 13 to have its free end portion detachably engaged with each of the detent grooves 32 of the dial disc 22. This enables each of the dial discs 22 to be held in its predetermined angular position, and therefore to establish a unique combination of the marks of the dial discs 22.

It is possible for the user to arbitrarily modify such a unique combination for unlocking the combination lock 19 by simply turning any one of dial discs 22 using his or her fingertip.

Such modification procedure of the combination of the marks is accomplished as follows: namely, in a condition in which the door handle 13 is in its raised position shown in FIG. 8, at first, it is necessary for the user to push up the lower-end latch member 35 into a hollow portion 36 (shown in FIG. 5) of the door handle 13 by using his or her finger, as shown in FIG. 51. When the lower-end latch member 35 is pushed up relative to the door handle 13, the lowermost one of the cam discs 23 is moved upward against a resilient force exerted by the coil spring member 27 since the lowermost cam disc 23 has its bottom surface abut against an interlocking ring 37 which is fixedly mounted on the locking member 24. As is clear from FIG. 51, the locking member 24 has its lower end portion engaged with the lower-end latch member 35, which makes it possible to move up the lowermost one of the cam discs 23 against the resilient force exerted by the coil spring member 27 when the lower-end latch member 35 is moved up into the hollow portion 36 of the door handle 13. As a result, an upper end portion of the cam disc 23 enters the small-diameter bore portion 22*a* of the dial disc 22 (FIG. 51), so that the positioning projection 26*a* of the cam disc 23 is axially moved up out of the positioning groove 31 (shown in FIG. 34) of the back plate member 21. At this time, the interlocking projection 26 of the cam disc 23 (shown in FIGS. 41 to 43) is engaged with the corresponding interlocking groove 25 of the dial disc 22 (shown in FIGS. 36 to 38).

As a result, the cam disc 23 is interlocked with the corresponding dial disc 22. Consequently, under such circumstances, when the dial disc 22 is turned through a predetermined angle by the user, the cam disc 23 is also turned through the same predetermined angle. After completion of modification in combination of the marks, when the lower-end latch member 35 is released from the pressure applied by the user's finger, the coil spring member 27 drives the cam disc 23 downward to force the upper end portion of the cam disc 23 to separate from the small-diameter bore portion 22*a* of the corresponding dial disc 22. As a result, only the dial disc 22 thus separated from the corresponding cam disc 23 become rotatable. Under such circumstances, when the dial disc 22 thus separated from the cam disc 23 is turned arbitrarily, it is possible to move the interlocking groove 25 of the dial disc 22 to an angular position in which the interlocking groove 25 fails to align with the interlocking projection 26 of the corresponding cam disc 23. In such an angular position, it is not possible for the cam disc 23 to enter the small-diameter bore portion 22*a* of the corresponding dial disc 22. This realizes the locked condition of operation.

When the eligible user who knows the unique combination of the marks of the dial discs 22 establishes such unique combination by turning the individual dial discs 23, the interlocking grooves 25 of the dial discs 22 align in angular position with the corresponding interlocking projections 26 of the cam discs 23 to receive these projections 26 therein, so that the combination lock 19 is unlocked.

As is clear from FIG. 51, a plurality of the cam discs 23 are vertically stacked into a neat pile between the coil spring member 27 and the interlocking ring 37 in a manner such that such a neat pile of the cam discs 23 are resiliently urged against the interlocking ring 37 under the effect of a resilient force exerted by the coil spring member 27 which is mounted over an upper end portion of the locking member 24.

In order to make it easy for the user to catch the marks applied to the outer peripheral surfaces of the dial discs 22 and also make it easy for the user to turn these dial discs 22 using his or her fingertip, the dial disc 22 is so arranged as to have a part thereof extended forward (as shown in FIGS. 1 and 2) from a slot 38 formed in the front surface of the door handle 13. In this embodiment, as is clear from FIG. 36, each of the marks of the dial discs 22 is constructed of a predetermined numeric character, for example such as any one of numerals from "0" to "9". These marks or numerals are angularly spaced apart from each other at predetermined equal angular intervals. On the other hand, the locking member 24 passes through the though-holes 23*a* formed in the centers of the cam discs 23.

As for the lower-end latch member 35 connected with the lower end portion of the locking member 24, it is also possible to make the lower-end latch member 35 an integral part of the locking member 24. As is clear from FIG. 7, the lower-end latch member 35 extends out of the hollow portion 36 of the door handle 13 through its lower-end opening 39 to engage with the projection portion 40 of the base body 1, wherein the projection portion 40 assumes substantially a triangular shape in cross section. In other words, the projection portion 40 of the base body 1 is provided with a front cam slope 42 and a rear cam slope 41. When the door handle 13 is in its folded position, the lower-end latch member 35 is brought into press-contact with the rear cam slope 41 of the projection portion 40 of the base body 1.

When the unique combination of the marks of the dial discs 22 is established by the eligible user who knows such unique combination, the interlocking groove 25 of the dial disc 22 is aligned in angular position with the interlocking projection 26 of the cam disc 23 to receive therein the interlocking projection 26 of the cam disc 23 when the cam disc 23 is moved upward in FIG. 51, which permits the combination lock 19 to be unlocked.

Figure 7:
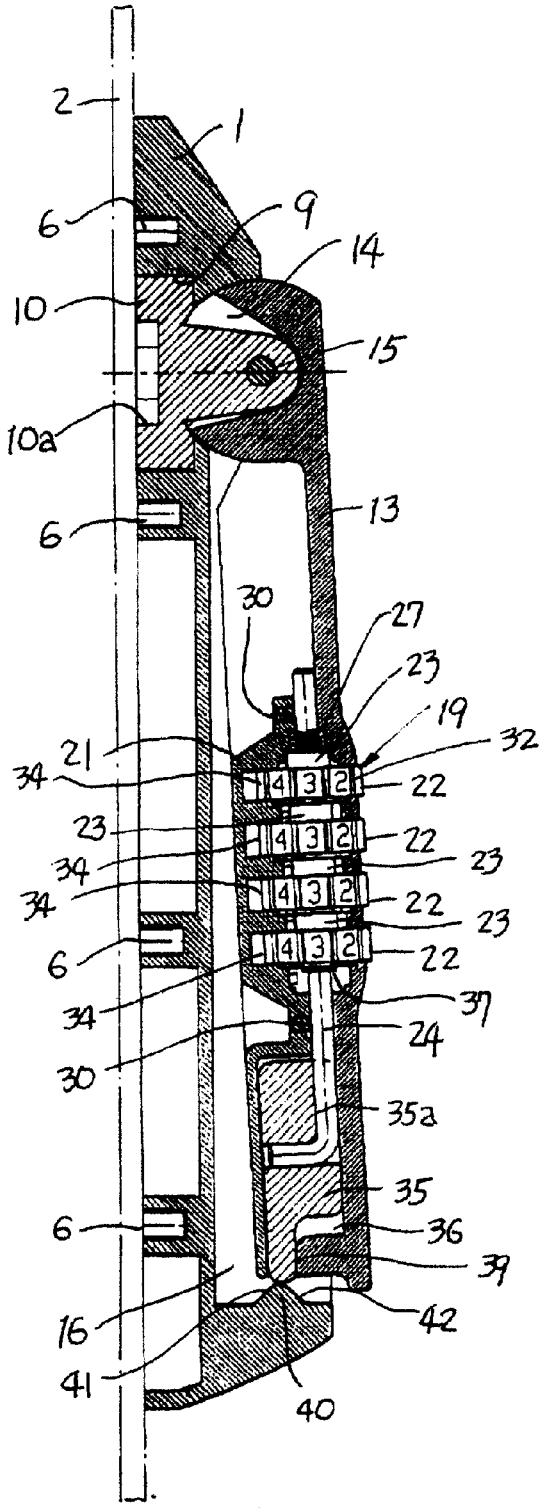
FIG. 7 is a longitudinal sectional view of the door locking handle assembly, taken along the line A—A of FIG. 1, which illustrates the door handle having been unlocked from the base body in the beginning of unlocking process of the door handle.

Under such circumstances, when the user has his or her fingertip engaged with the fingertip engaging edge portions 17 of the lower free end portion of the door handle 13 and swingably pulls forward the door handle 13 from the front surface of the base body 1, as shown in FIGS. 7 and 8, the locking member 24 is pushed upward through the lower-end latch member 35 against a resilient force exerted by the coil spring member 27 since the lower end portion of the lower-end latch member 35 having been connected with the locking member 24 is pushed upward by means of a rear cam slope 41 of a projection portion 40 which is provided in an inner peripheral surface of a lower end portion of the base body 1, as is clear from FIGS. 7 and 8.

In a brief summary, a time when the door handle 13 is released from the base body 1 is a time when the lower-end latch member 35 is pushed upward to reach its uppermost position shown in FIG. 7. After the lower-end latch member 35 reaches its uppermost position, the door handle 13 is further pulled up or swung forward through a predetermined angle, as shown in FIG. 8. Then, the door handle 13 is turned sideward on the locking shaft 10 through a predetermined angle in a direction perpendicular to the paper of FIG. 8, so that the rack 12 of the door 2 is retracted from a stationary frame element of the box, wherein such a stationary frame element is disclosed in the prior art: U.S. Pat. No. 5,467,623, herein incorporated by reference. As a result, the door 2 is unlocked from the stationary frame element of the box.

In the door locking handle assembly of the present invention having the above construction, a control operator of the instruments housed in the box allocates to each of a large number of eligible users a unique combination of marks of the marked dial discs 22 of the combination lock 19 for unlocking and locking the combination lock 19. Due to this, even when the door locking handle assembly using the combination lock 19 is small as a whole in thickness, the door locking handle system of the present invention is capable of permitting, through its computerized personal management system, a plurality of persons or users to have easily and quickly access to their instruments contained in the box provided with the door locking handle assembly of the present invention.

Each of the eligible users is capable of unlocking the combination lock 19 of the door locking handle assembly by turning in a normal or a reverse direction each of the marked dial discs 22 a given number of times to establish the unique combination having been allocated to each user, wherein the marks are provided in an outer peripheral surface of each of the dial discs 22.

Once such a unique combination of the marks is established, the combination lock 19 is capable of moving to its unlocking position. Through this movement to the unlocking position of the combination lock 19, the locking member 24 or the lower-end latch member 35 connected with the lower end portion of the locking member 24 is released from its restricted condition and capable of moving to its unlocking position. Due to this, the door handle 13 is released from the base body 1 of the door locking handle assembly to move to its pulled-up or inclined position. At this time, i.e., when the door handle 13 is swingably pulled out of the base body 1, the lower-end latch member 35, which is connected with the lower end portion of the locking member 24 and brought into press-contact with the rear cam slope 41 of the projection portion 40 of the base body 1, is pushed upward against the resilient force, which is exerted by the coil spring member 27 on the lower-end latch member 35 through the locking member 24, to permit the lower-end latch member 35 to be disengaged from the rear cam slope 41 of the projection portion 40 of the base body 1. As a result, it is possible for the user to turn the door handle 13 forward through a predetermined angle up to its pulled-up or raised position.

When the door handle 13 is pulled forward out of the base body 1 and then turned on its locking shaft 10 sideward, the rack 12 serving as a door bolt for the door 2 is slidably moved downward relative to the door 2 and therefore disengaged from the receiving portion of the stationary frame element such as the main body of the box, which permits the door 2 of the box to be opened.

As is clear from the above, in the door locking handle assembly of the present invention with the built-in combination lock 19, since the locking member 24 is so arranged as to pass through the central through-hole 22*a*, 22*b* of each of the dial discs 22 of the combination lock 19 and to extend in parallel with the longitudinal axis of the door handle 13, it is possible for the door handle 13 to remarkably reduce its thickness as a whole in construction, which permits the height of the door locking handle assembly of the present invention from the front surface of the door 2 to the front surface of the door handle 13 of the assembly to be the lowest possible level.

Furthermore, in the door locking handle assembly of the present invention: the lower-end latch member 35 connected with the lower end portion of the locking member 24 is detachably engaged with the projection portion 40 of the base body 1; both the dial discs 22 and the locking member 24 including the lower-end latch member 35 connected therewith are resiliently urged downward by means of the coil spring member 27; and, the projection portion 40 of the base body 1 is provided with the rear cam slope 41 for driving the lower-end latch member 35 upward against a resilient force exerted by the spring member 27 when the door handle 13 is pulled out of the base body 1 after the combination lock 19 is unlocked. Due to the above construction, in the door locking handle assembly of the present invention, there is little need to construct a means for driving the locking member 24 with separate components. This enables the door locking handle assembly of the present invention to considerably reduce the number of its components and therefore considerably simplify its construction and reduce the manufacturing cost to a large extent.

While the present invention has been particularly shown and described with reference to the preferred embodiments and a modification thereof, it will be understood by those skilled in the art that various modifications and changes may be made therein without departing from the spirit of the present invention as defined by the appended claim.

What is claimed is:

1. In a door locking handle assembly with a built-in combination lock (19), the assembly being provided with a base body (1) which is fixedly mounted on a door (2), wherein a door handle (13) is pivoted to said base body (1) so as to be capable of being pulled out forward and pushed back rearward relative to said base body (1) and also turning sideward on a locking shaft (10) after completion of its pulling-out operation, wherein a rack (12) serving as a door bolt for said door (2) is directly or indirectly connected with said door handle (13) so as to be engaged with and disengaged from a receiving portion of a stationary frame element such as a main body of a box when said door handle (13) is pulled out forward and then turned sideward on said locking shaft (10) after completion of the pulling-out operation of said door handle (13), said rack (12) being slidably supported and guided in its up and down linear motion relative to said door (2), wherein said door (2) is swingably supported by said stationary frame element, the improvement wherein:

said combination lock (19), which is provided with a plurality of marked dial discs (22), is incorporated in said door handle (13) and opened by turning each of said marked dial discs (22) a given number of times to establish a predetermined combination of marks provided in outer peripheral surfaces of said dial discs (22);

a locking member (24) for preventing said door handle (13) from being pulled out of said base body (1) is juxtaposed with an inner surface of said door handle (13) to pass through a central portion of each of said plurality of said marked dial discs (22) of said combination lock (19);

said base body (1) is provided with a projection portion (40) in an inner peripheral surface of its lower end portion, wherein said projection portion (40) is provided with a front cam slope (42) and a rear cam slope (41) to have each of said cam slopes (42, 41) be engageable with a lower-end latch member (35) which is connected with a lower end portion of said locking member (24), wherein said rear cam slope (41) of said projection portion (40) drives said lower-end latch member (35) upward against a resilient force exerted by a spring member (27) when said door handle (13) is pulled out of said base body (1) after said combination lock (19) is unlocked; and all said marked dial discs (22), said locking member (24) and said lower-end latch member (35) are resiliently urged downward under the influence of said resilient force exerted by said spring member (27), which permits said lower-end latch member (35) to be engaged with and disengaged from said projection portion (40) of said base body (1) when said combination lock (19) is locked and unlocked, respectively.

2. The door locking handle assembly of claim 1, wherein said door handle (13) is connected to said rack (12) by a pinion shaft (11) and pinion gear, whereby a sideward turning of said door handle (13) and said locking shaft (10) can move said rack (12) upward and downward relative to said door (2).

3. The door locking handle assembly of claim 1, wherein said combination lock (19) includes said plurality of said marked dial discs (22) in an alternating relationship with an equal number of adjacent cam discs (23), said dial discs (22) and said cam discs (23) being rotatably mounted on said elongated locking member (24).

4. The door locking handle assembly of claim 3, wherein said marked dial discs (22) can each be interlocked to each adjacent said cam disc (23) by a plurality of positioning projections **(26*a*) which are inserted axially into a mating positioning groove (31)**.

5. The door locking handle assembly of claim 3, wherein each said marked dial disc (22) has a plurality of detent grooves (32) provided equally spaced apart on the dial disc outer periphery, each said dial disc (22) being held in a predetermined angular position by a detent leaf spring (33) fixedly mounted in said handle (13).

6. The door locking handle assembly of claim 4, wherein said door handle (13) has an elongated hollow portion (20) covered by a backplate member (21) which is provided with at least one positioning groove (31) which is engaged with a positioning projection **(26*a*)**.

7. In a door locking handle assembly with a built-in combination lock (19), the assembly being provided with a base body (1) which is fixedly mounted on a door (2), wherein a door handle (13) is pivoted to said base body (1) so as to be capable of being pulled out forward and pushed back rearward relative to said base body (1) and also turning sideward on a locking shaft (10) after completion of its pulling-out operation, wherein a rack (12) serving as a door bolt for said door (2) is directly or indirectly connected with said door handle (13) so as to be engaged with and disengaged from a receiving portion of a stationary frame element such as a main body of a box when said door handle (13) is pulled out forward and then turned sideward on said locking shaft (10) after completion of the pulling-out operation of said door handle (13), said rack (12) being slidably supported and guided in its up and down linear motion relative to said door (2), the improvement wherein:

said combination lock (19), which is provided with a plurality of marked dial discs (22), is incorporated in said door handle (13) and opened by turning each of said marked dial discs (22) a given number of times to establish a predetermined combination of marks provided in outer peripheral surfaces of said dial discs (22); each said marked dial discs (22) being held in a desired angular position by detent leaf spring (33) fixedly mounted in said door handle (13);

a locking member (24) for preventing said door handle (13) from being pulled out of said base body (1) is juxtaposed with an inner surface of said door handle (13) to pass through a central portion of each of said plurality of said marked dial discs (22) and an equal number of cam discs (23) provided each located adjacent to the dial discs (22) of said combination lock (19);

said base body (1) is provided with a projection portion (40) in an inner peripheral surface of its lower end portion, wherein said projection portion (40) is provided with a front cam slope (42) and a rear cam slope (41) to have each of said cam slopes (42, 41) be engageable with a lower-end latch member (35) which is connected with a lower end portion of said locking member (24), wherein said rear cam slope (41) of said projection portion (40) drives said lower-end latch member (35) upward against a resilient force exerted by a spring member (27) when said door handle (13) is pulled out of said base body (1) after said combination lock (19) is unlocked;

all said marked dial discs (22), said locking member (24) and said lower-end latch member (35) are resiliently urged downward under the influence of said resilient force exerted by said spring member (27), which permits said lower-end latch member (35) to be engaged with and disengaged from said projection portion (40) of said base body (1) when said combination lock (19) is locked and unlocked, respectively, said marked dial discs (22) being provided in an alternating relationship with an equal number of adjacent cam discs (23) all rotatably mounted on said elongated locking member (24); whereby said marked dial discs can be interlocked to each adjacent said cam disc (23) by a plurality of positioning projections **(26*a*) which are inserted into a mating positioning groove (31); and said door handle (13) is connected to said rack (12) by a pinion shaft (11) and pinion gear, whereby a sideward turning of said door handle (13) and said locking shaft (10) can move said rack (12) upward and downward relative to said door (2)**.

* * * * *